US005262269A

United States Patent [19]

Nair et al.

[11] Patent Number: 5,262,269

[45] Date of Patent: Nov. 16, 1993

[54] PROCESS FOR MAKING TONER PARTICLES WHEREIN THE PIGMENT IS DISPERSED IN THE TONER

[75] Inventors: Mridula Nair, Penfield; Zona R. Pierce; Louis J. Sorriero, both of Rochester; Dinesh Tyagi, Fairport, all of N.Y.

[73] Assignee: Eastman Kodak Company, Rochester, N.Y.

[21] Appl. No.: 855,207

[22] Filed: Mar. 20, 1992

Related U.S. Application Data

[62] Division of Ser. No. 501,819, Mar. 30, 1990, Pat. No. 5,118,588.

[51] Int. Cl.[5] ..... G03G 9/08

[52] U.S. Cl. ..... 430/137; 430/110; 430/111; 428/402.24

[58] Field of Search ..... 430/137, 110, 111; 428/402.24

[56] References Cited

U.S. PATENT DOCUMENTS

| | | | |
|---|---|---|---|
| 4,851,318 | 7/1989 | Hsieh et al. | 430/137 |
| 4,912,009 | 3/1990 | Amering et al. | 430/137 |
| 5,102,763 | 4/1992 | Winnik et al. | 430/137 |

FOREIGN PATENT DOCUMENTS 58-147753 9/1983 Japan .

*Primary Examiner*—Marion E. McCamish
*Assistant Examiner*—S. Rosasco
*Attorney, Agent, or Firm*—Dressler, Goldsmith, Shore, Sutker, & Milnamow, Ltd.

[57] ABSTRACT

Pigmented toner particles are provided wherein, because of treatment with a surface modifier, an initially hydrophilic, sub-micron sized pigment is made hydrophobic. Toner particles are produced wherein the pigment is dispersed internally leaving surfaces substantially free from pigment.

11 Claims, 6 Drawing Sheets

PROCESS FOR MAKING TONER PARTICLES WHEREIN THE PIGMENT IS DISPERSED IN THE TONER

This application is a division of application Ser. No. 07/501,819, filed Mar. 30, 1990 now U.S. Pat. No. 5,118,588.

FIELD OF THE INVENTION

This invention is in the field of high transfer efficiency toner particles that are produced with initially hydrophilic pigments that are rendered hydrophobic.

BACKGROUND OF THE INVENTION

In electrostatic copying processes, a latent electrostatic image formed on an element is developed into a visible image with toner particles.

So called dry or particulate toner powders can be prepared by a variety of techniques. In one process, a water-immiscible polymerizable liquid monomer and colorant (i.e., pigment or dye) are dispersed as droplets in an aqueous medium containing a colloidally sized suspending agent. The monomer is polymerized to form solid colorant containing polymeric particles that are separated and dried. The process is useful in making very small particle size toner powders (under about 10 microns) that can be employed in making high resolution developed toned images. The limited coalescence process is described, for example, in U.S. Pat. No. 3,615,972.

Another example is an evaporation limited coalescence process, where the stabilizer used is also a colloidal silica, or the like, and where the suspended small droplets comprise a solution of polymer in a non-aqueous, water immiscible solvent liquid. The solvent is removed and the particles are separated, washed and dried. Such a process is disclosed in U.S. Pat. No. 4,833,060.

A further example is a limited coalescence polymerization process wherein the stabilizer used is an emulsion polymerized aqueous latex of certain copolymers containing oleophilic and hydrophilic combined monomers as is disclosed in published European Patent Application No. 0 334 126.

SUMMARY OF THE INVENTION

The present invention is directed to a process whereby the aforementioned limited coalescence procedures can be used to produce pigmented toner powders, that have excellent transfer efficiencies. The present invention, is also directed to toner powders having excellent transfer efficiencies.

In accordance with the present invention, initially hydrophilic, sub-micron sized pigment particles are made hydrophobic through contact with a surface modifier. The surface modifier is sufficiently interactive with the pigment particles to render them hydrophobic. The surface modifier contains at least one functional group per molecule.

The treated hydrophobic pigments produce toner particles with improved transfer efficiencies. The toner particles of the present invention are characterized by having the pigment dispersed in interior particle regions with particle surfaces being substantially free from the pigment.

The hydrophobicity of the pigments produced by this invention is sufficient to drive such pigments away from suspended droplet surface regions into the interior regions thereof. The surfaces which result are substantially free of pigment. As a result, the charge on individual toner particles of the invention does not decay, and the transfer efficiency of the toner particles is substantially higher during image transfer. Also, the surface energy of the toner powders of this invention is lower when pigment is not on the particle surfaces. The lower surface energy reduces adhesion of toner particles to an element, thereby requiring less energy to transfer the toner from the element to a receiver. Furthermore, the method of the present invention provides toners whose charge is less dependant on relative humidity.

Other and further aims, features, advantages, uses, and the like will be apparent to those skilled in the art when taken with the accompanying drawings and appended claims.

DETAILED DESCRIPTION OF THE INVENTION

(a) Definitions

Figure 1:
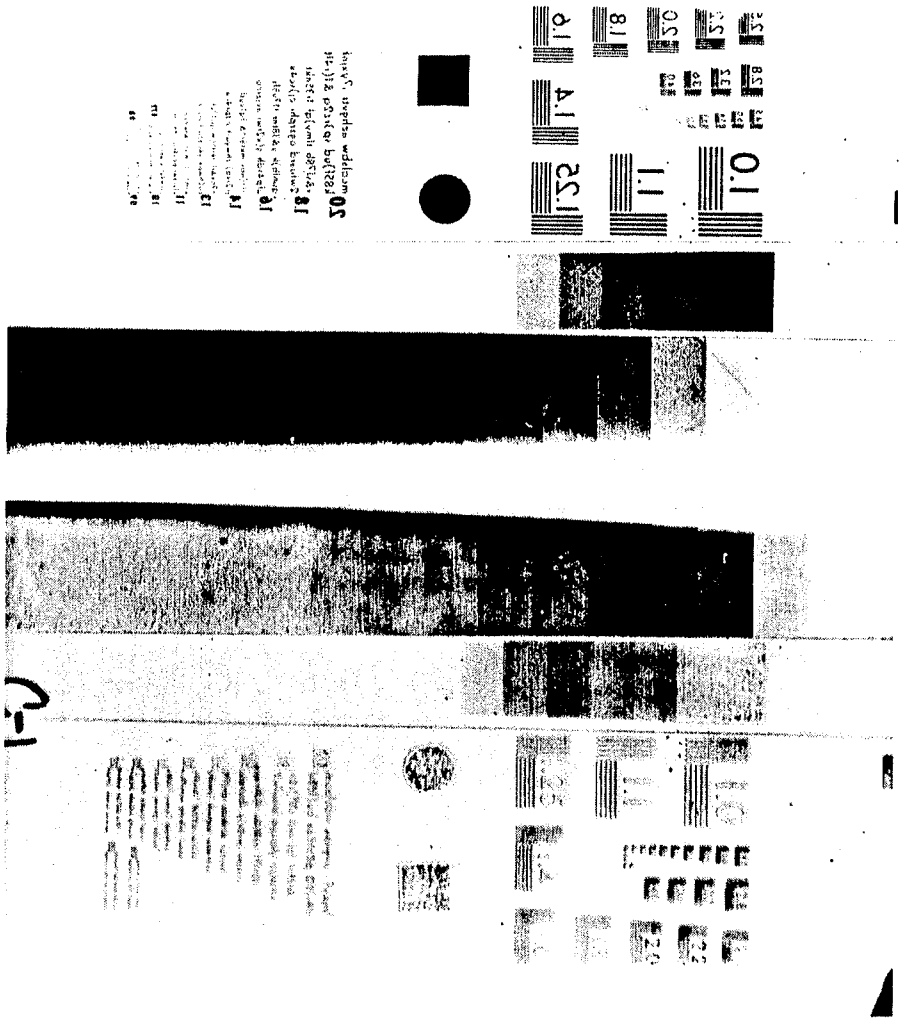
FIG. 1 is an electrophotograph of a transferred image and the transfer residue for a polymerization limited coalescence control toner particle.

The term "particle size" as used herein, or the term "size," or "sized" as employed herein in reference to the term "particles," means volume weighted diameter as measured by conventional diameter measuring devices, such as a Coulter Multisizer, sold by Coulter Electronics, Inc. Mean volume weighted diameter is the sum of the mass of each particle times the diameter of a spherical particle of equal mass and density, divided by total particle mass.

The term "glass transition temperature" or "$T_g$" as used herein means the temperature at which a polymer changes from a glassy state to a rubbery state. This temperature ($T_g$) can be measured by differential thermal analysis as disclosed in "Techniques and Methods of Polymer Evaluation", Vol. 1, Marcel Dekker, Inc., N.Y. 1966.

The term "pigment" or "pigment particles" as used herein, refers to a finally divided solid that is usually substantially insoluble in water and organic solvents and that has a positive colorant value (black, white, or colored). A pigment imparts a color to another substance, such as a toner powder.

As used herein, the term "hydrophilic" means that a substance, such as a pigment, has some affinity for, or a capacity to, attract, absorb, or adsorb water.

Similarly, as used herein, the term "hydrophobic" means that a substance, such as a pigment, lacks an affinity for, or repels, or fails to absorb or adsorb water.

(b) Pigment

The pigmented toner particles of the invention incorporate sub-micron sized pigment particles.

In relation to the present toner particles, the pigment is generally initially hydrophilic. However, in accordance with the teachings of the present invention, the pigment is contacted with a pigment dispersant and a surface modifier that has been incorporated into the toner particles and that is sufficiently interactive with the pigment to render the pigment hydrophobic. The surface modifier contains at least one functional group per molecule as characterized herein that is reactive to the surface of the pigment.

Examples of suitable pigments include the various magnetic oxides, including ferric and ferrous oxides, cobalt oxides, and the like; carbon; phthalocyanines; and the like. Carbon pigments are presently most preferred for use in the practice of this invention.

Since the pigment particles must be smaller in size than the dispersed droplets in the aqueous medium employed for toner particle preparation in accordance with the present invention, and since the dispersed droplets may be only a few microns in particle size (diameter), the pigment particles should generally be in the sub-micron size range at the time of their use in this invention.

At the time when the non-aqueous droplets are dispersed in the aqueous medium (as taught herein), pigment particles should have a hydrophobicity which is greater than that of the liquid phase of the individual droplets so that the pigment particles are absent from surfaces of the droplets.

Those skilled in the art will appreciate that hydrophobic pigment particles can be obtained in various ways. Known methods for rendering naturally hydrophilic carbon pigments hydrophobic include corona treatment, thermal treatment, and particle coating with various chemicals. However, such particles can be disadvantageous for use in making toner particles by the methods taught in this invention. For example, in the case of hydrophobic carbon pigments, the color presented occasionally can be grey instead of black, so that such a pigment can not be used to produce a black toner. To produce a black toner, it is preferable to begin with a naturally hydrophilic carbon pigment that is black and then treat it to make it hydrophobic while maintaining its tinting strength.

In accordance with the present invention, it has now been discovered that a hydrophilic pigment such as carbon can be treated with a surface modifier of the class taught herein prior to or during the incorporation of such pigment with a non-aqueous liquid system intended for use in toner particle production using limited coalesence. The hydrophilic pigment particles, such as carbon normally have reactive groups on their surfaces, including, for example, groups such as hydroxyl, carboxyl, sulfonyl, and the like. The surface modifier employed in the present invention is believed to react with such groups and to cause pigments treated therewith to achieve sufficient particle hydrophobicity without decreasing their tinting or tinctorial strength to be useful in the practice of this invention.

In order to prepare a pigment having a size as above indicated, it may be desirable to reduce the particle size of the pigment from an initial size to a submicron or colloidal size. Thus, the pigment in combination with a surface modifier of the type employed in the practice of this invention can be ball milled in the presence of the polymerizable monomer mixture, or the thermoplastic polymer solution or, even compounded with the thermoplastic polymer on a hot roll mill.

Partially solvent soluble pigments can be used, such as, for example, bis(phthalocyanyl-alumino) tetraphenyl-disiloxane cyan pigments, or the like.

Carbon pigments having about a neutral pH (that is, a pH of about 7) are presently more preferred; however, carbon pigments having a basic pH can be used. An example of a carbon pigment with a pH of about 7 is "Regal TM 300" which is available commercially from Cabot Corporation while an example of a carbon pigment having a basic pH is "Monarch TM 800" which has a pH of about 8.5 and is available commercially from Cabot Corporation.

(c) Surface Modifier

The pigmented toner particles of the invention incorporate a surface modifier that contains functional groups.

Preferably, the surface modifier, to the extent that it is not reacted with the pigment, is dissolved in the non-aqueous organic liquid medium that comprises the droplets that are dispersed in the aqueous medium employed in the practice of this invention.

In general, the surface modifier contains, per molecule, at least one functional group that can react with the functional groups associated with pigment particle surfaces. Examples of suitable functional groups that are incorporated into the surface modifier include:

(a) carboxylic acid (—COOH) groups and groups that form carboxylic acid groups, such as, for example, carboxylic acid halides and carboxylic acid salts, such as those wherein the salt cation is selected from the group consisting of alkali metals, alkaline earth metals, and ammonium (preferably, alkali metal salts); and (b) sulfonic acid ($—SO_3H$) groups and groups that form sulfonic acid groups, such as, sulfonic acid halides and sulfonic acid salts, such as those wherein the salt cation is selected from the group consisting of alkali metals, alkaline earth metals, and ammonium (preferably, alkali metal salts).

Functional groups of class (a) above are presently preferred as a class. For convenience herein, the term "carboxylic acid group" is inclusive of the individual groups of class (a) while the term "sulfonic acid group" is inclusive of the individual groups of class (b).

One presently preferred class of surface modifiers suitable for use in this invention comprises compounds of the formula:

RA wherein:

R is a hydrocarbon group having at least six carbon atoms per molecule; and

A is a carboxylic acid group. It is presently preferred for an R group to contain at least 14 carbon atoms.

The R group can be, or can contain, groups such as alkyl, alkylene, aryl, aralkyl, alkaryl, or the like. It is presently preferred for the R group to be alkyl or alkylene. More preferred alkyl or alkylene groups are straight or branched chain hydrocarbon groups.

The R group and the A group can comprise a fatty acid. Examples of saturated fatty acids include lauric acid, myristic acid, palmitic acid, stearic acid, and the like. Examples of unsaturated fatty acids include alphaoleostearic acid, arachidonic acid, beta-oleostearic acid, lauroleic acid, lineoleic acid, linolenic acid, oleic acid, palmitoleric acid, palmitoleic acid, sorbic acid, and the like.

Another presently preferred class of surface modifiers comprises polycarboxylic acids which contain at least 5% by weight of carboxylic acid groups per molecule, and the remainder consisting of aliphatic or aromatic hydrocarbon moieties containing at least 8 carbon atoms. Representative dispersants of this class are oleoyl chloride and lauryl chloride.

Another presently more preferred class of surface modifiers is a copolymer that comprises on a 100 weight percent basis about 1 to about 5 weight percent methacrylic acid, and about 95 to about 99 weight percent styrene.

The carboxyl groups in such a copolymer can be in the acid halide or acid salt form. Such a copolymer preferably has a molecular weight in the range of about 1,000 to about 30,000. Such copolymers can be in the random or block form.

Another presently preferred class of surface modifiers is a copolymer of styrene with 2-sulfoethyl methacrylate.

(d) Pigment Dispersants

The surface modifiers described above are generally used in combination with dispersants such as Kraton TM, a styrene-alkylene block copolymer available from Shell Chemical Co.

(e) Additives

Toner particles of this invention can contain other additives which are dissolved or dispersed in the thermoplastic polymer. In particular, toner particles of this invention usually and preferably contain a charge control agent.

Suitable charge control agents can be selected from among those taught in the prior art; see, for example, the teachings of U.S. Pat. Nos. 3,893,935; 4,079,014; and 4,323,634; and British Patent Nos. 1,501,065 and 1,420,839.

Examples of other types of additives include plasticizers, and promoters, as for example, those disclosed in U.S. Pat. No. 4,833,060.

(f) The Aqueous Medium

In the practice of the processes of this invention, an aqueous medium is employed. This medium contains dispersed therein colloidally sized droplet suspendinq agents which function to control particle size and size distribution in toner powders.

Suitable colloidal suspending agents include, for example, calcium phosphate, silica, alumina, methyl cellulose, and the like. One presently preferred type of suspending agent is colloidal silica. Another presently preferred type of suspending agent is an aqueous latex of a colloidal copolymer which comprises:

(a) about 25 to about 80 weight percent of an addition polymerizable oleophilic monomer;

(b) about 5 to about 45 weight percent of an addition polymerizable hydrophilic monomer;

(c) about 1 to about 50 weight percent of an addition polymerizable ionic monomer; and (d) about 8 to about 20 weight percent of a cross-linking monomer having at least two addition polymerizable groups.

Preferably, the copolymer comprises about 35 to about 65 weight percent oleophilic monomer, about 10 to about 35 weight percent hydrophilic monomer, about 10 to about 20 weight percent ionic monomer, and about 10 to about 15 weight percent cross-linking monomer.

The quantity of colloidal suspending agent present in such aqueous medium typically is in the range of about 0.2 to about 20 weight percent on a 100 weight percent total aqueous medium basis, and preferably in the range of about 0.5 to about 6 weight percent.

While the non-aqueous liquid organic phase is dispersed as droplets in the aqueous phase, the colloidal suspending agents serve as a third phase. These agents as a class are insoluble in both the aqueous phase and the non-aqueous phase; however, these agents are in effect wetted by the droplets. The colloidal suspending agents are more hydrophilic than oleophilic, and more hydrophilic than the dispersed or suspending droplets; thus, they remain at the interface of the aqueous phase and the suspended droplets. The colloidal suspending agents substantially uniformly cover the surface of the suspended droplets and can be regarded as forming a layer on such droplets.

(g) Polymerization Limited Coalescence

In accordance with the present invention, a limited coalescence suspension polymerization process is used to produce toner particles.

Thus, a pigment is colloidally dispersed in a polymerizable water immiscible liquid monomer composition by known techniques together with additives, the surface modifier and the pigment dispersant as described herein.

The liquid monomer composition is preferably comprised of monomers that are water immiscible or insoluble, so that they do not dissolve or merge with the aqueous medium. While a wide variety of monomers can be used for this purpose, typical and illustrative suspension polymerizable toner monomers include those that contain ethylenic unsaturation and polymerize by addition. Suitable monomers include for example, styrene, p-chloro-styrene; vinyl naphthalene; ethylenically unsaturated mono-olefins, such as ethylene, propylene, butylene and isobutylene; vinyl halides, such as vinyl chloride, vinyl bromide, vinyl fluoride; vinyl carboxylates, such as acetate; vinyl propionate, vinyl benzoate, vinyl butyrate, and the like; esters of alpha-methylene aliphatic monocarboxylic acids, such as methyl acrylate, methyl methacrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate, and the like; acrylic compounds, such as acrylic acid, methacrylic acid,; acrylonitrile; methacrylonitrile; acrylamide; vinyl ethers, such as vinyl methyl ether, vinyl isobutyl ether, vinyl ethyl ether, and the like; vinyl ketones, such as vinyl methylketone, vinyl hexyl ketone, methyl isopropyl ketone, and the like; vinylidene halides, such as vinylidene chloride, vinylidene chlorofluoride, and the like; N-vinyl compounds, such as N-vinyl pyrrole, N-vinyl carbazole, N-vinyl indole, N-vinyl pyrrolidene, and the like; divinyl benzene; styrene and various derivatives of styrene, such as methylstyrene, ethylstyrene, and the like; allyl compounds, such as allyl chloride, methallyl ethyl ether, and the like and mixtures thereof. A presently preferred monomer composition is a mixture containing styrene or a derivative of styrene and an acrylate; butylacrylate is especially preferred in such a mixture as it produces a thermoplastic polymer having a $T_g$ in the range of about 40° to about 100° C.

The resulting non-aqueous liquid dispersion is then admixed under high shear conditions with the aqueous medium described above to produce a suspension of micron-sized droplets of the dispersion in the aqueous medium. Typically, these droplets are highly uniform in size and the size is in the range of about 2 to about 30 microns, and preferably about 2 to about 10 microns. During the high shear mixing, an equilibrium is reached as regards droplet size. Droplet size deviation is typically about ±25% of the mean.

Next, the monomer mixture in the suspended droplets is polymerized. The polymerization can be accomplished by heating or irradiating the droplet suspension under mild to moderate agitation. An initiator that is included in the dispersion before it is admixed with the aqueous medium promotes the polymerization. Examples of suitable initiators for such a suspension polymerization include organic soluble free radicals e.g., Vazo 52 (DuPont) 2,2'-azobis(2,4-dimethylnitrate) and benzoyl peroxide.

Typical suspension heating temperatures are in the range of about 30° to about 100° C. However, the particular conditions used for polymerization in any given situation depend upon a number of variables, such as the monomer composition, the initiators present, and the like. The use of gentle continuous agitation aids in preventing droplet agglomeration or coalescing.

After polymerization is complete, the particles can be separated from the aqueous medium by any conventional means, including settling, filtration, centrifuging, combinations thereof, or the like. After separation, the particles are preferably washed with water and residual suspending agents removed.

In the case, for example, of silica, it can be removed by washing with a dilute aqueous alkali metal or ammonium hydroxide. If washed with base, the particles are thereafter further water washed until a neutral pH (about 7) is reached. The resulting particles are then conveniently drained and dried to remove residual water.

A suitable drying temperature is in the range of about ambient to about 60° C. applied for times of about 3 to about 24 hours.

The particles produced by such a suspension polymerization and drying process have a particle size that is preferably in the range of about 2 to about 10 microns.

(h) Evaporation Limited Coalescence

In accordance with the present invention, a limited coalescence polymer suspension process is used to produce toner particles.

Thus, a pigment is colloidally dispersed in a solution or a colloidal dispersion of thermoplastic polymer in a water-immiscible organic carrier liquid by known techniques. The dispersion contains additives as described herein.

Examples of suitable polymers which can be used if they are found to have characteristics as above indicated include, for example, olefin homopolymers and copolymers, such as polyethylene, polypropylene, polyisobutylene, polyisopentylene, and the like; polyfluoroolefins, such as polytetrafluoroethylene; polyamides, such as polyhexamethylene adipamide, polyhexamethylene sebacamide and polycaprolactam, and the like; acrylic resins, such as polymethylmethacrylate, polyacrylonitrile, polymethylacrylate, polyethylmethacrylate styrene-methylmethacrylatae copolymers, ethylene-methyl acrylate copolymers, ethylene-ethyl acrylate copolymers, ethylene-ethyl methacrylate copolymers,and the like; polystyrene and copolymers of styrene with unsaturated monomers, cellulose derivatives, such as cellulose acetate, cellulose acetate butyrate, cellulose propionate, cellulose acetate propionate, ethyl cellulose and the like; polyesters; polycarbonates; polyvinyl resins, such as polyvinyl chloride, copolymers of vinyl chloride, vinyl acetate, polyvinyl butyral, polyvinyl alcohol, polyvinyl acetal, ethylene-vinyl acetate copolymers, ethylene-vinyl alcohol copolymers, and the like; allyl polymers, such as ethylene-allyl copolymers, ethylene-allyl alcohol copolymers, ethylene-allyl acetone copolymers, ethylene-allyl benzene copolymers, ethylene-allyl ether copolymers, and the like; ethylene-acrylic copolymers; polyoxymethylene; and various polycondensation polymers, such as polyurethanes, polyamides, and the like; and mixtures thereof.

Presently preferred are condensation polyesters.

Various water immiscible organic carrier liquids can be used. Examples of useful carrier liquids that preferably dissolve the polymer and which are also immiscible with water include, for example, chloromethane, dichloromethane, ethyl acetate, vinyl chloride, methyl ethyl ketone, trichloromethane, carbon tetrachloride, ethylene chloride, trichlorethane, toluene, xylene, cyclohexanone, 2-nitropropane, mixtures thereof, and the like. A particularly useful carrier liquid is ethyl acetate or dichloromethane because they are good solvents for many polymers while at the same time they are immiscible with water. Further, their volatility is such that they can be readily removed from the discontinuous phase droplets by evaporation during particle preparation.

The dispersion is then admixed under high shear conditions with the aqueous medium described above to produce a suspension of micron-sized droplets of the dispersion in the aqueous medium. Typically, these droplets are highly uniform in size and the size is in the range of about 2 to about 50 microns, and preferably about 5 to about 20 microns. During the high shear mixing, an equilibrium is reached as regards droplet size. Droplet size deviation is typically about ±25% of mean.

Next, while gentle agitation is employed, evaporation of the water immiscible organic carrier liquid is carried out. Initially, the average particle size of the suspended material reflects a swollen condition because of the presence of the carrier liquid. As evaporation occurs, the size of the particles decreases. Any convenient condition can be employed for accomplishing evaporation, but preferably ambient temperatures are employed in order to avoid exposing the droplets and developing particles to temperatures which might adversely affect the structure thereof.

After an initial period, the suspension is subjected to subatmospheric pressures to evaporate residual carrier liquid while stirring is continued. Suitable subatmospheric pressures are in the range of about 10 to about 25 mm Hg.

As a result of the carrier liquid evaporation, the particle size of the resulting solid particles is in the range of about 1.5 to about 30 microns, and preferably about 2 to about 10 microns.

After evaporation of the carrier liquid has been accomplished, the suspended particles are separated, washed to a preferably neutral pH, and dried using a procedure such as above described in reference to the foregoing particle preparation method of this invention. Dried particles have characteristics similar to those of the particles that are produced by suspension polymerization using limited coalescence.

Specifically, the particles produced by such a polymer suspension polymerization process have a particle size preferably within the range of about 2 to about 20 microns. Preferably, on a 100 weight percent total dispersion basis, the quantity of Formula (1) colorant present therein is in the range of about 5 to about 20 weight percent.

(i) Pigmented Toner Powders

Pigmented toner powders (or particles) of the present invention comprise:

an initially hydrophilic, sub-micron sized pigment;

a surface modifier that contains at least one functional group; and a thermoplastic polymer.

In each pigmented toner particle, the pigment is dispersed in interior particle regions and particle surfaces are substantially free of pigment.

Preferably toner powders additionally contain a charge control agent.

The pigmented and dried toner particles have a particle size in the range of about 1 to about 100 microns, and preferably in the range of about 2 to about 20 microns.

Preferably, particles of this invention have a narrow particle size distribution. For example, a size deviation in the range of about ±25% from a mean particle size is presently preferred, although somewhat larger and smaller such deviations are acceptable.

Toner particles of this invention on a 100 weight percent total weight basis comprise:

about 0 to about 20 weight percent of pigment;

about 0 to about 10 weight percent of surface modifier; and about 70 to about 99.95 weight percent of polymer.

Additionally, on the same basis, toner particles can contain from 0.005 up to about 5 weight percent of a charge control agent, and preferably about 0.1 to about 2 weight percent of charge control agent.

The invention is illustrated by the following examples:

EXAMPLE 1

An organic phase was prepared from 4 g of a block copolymer of styrene and ethylene-propylene sold by Shell under the trade designation "Kraton G1652," 64.5 g of styrene, 21.5 g of butylacrylate, and 8 g of hydrophilic carbon sold by Cabot as "Regal 300". The organic phase was mixed until all of the copolymer was dissolved therein. The organic phase was then treated with 0.53 g oleoyl chloride and was stirred for 15 minutes. The oleoyl chloride reacted with the groups on the surface of the carbon to produce carbon that was more hydrophobic than the liquid organic phase. This was followed by the addition of 0.2 g of t-dodecyl mercaptan, a chain transfer agent which limits the molecular weight of the polymerizing monomer, and 2.6 g of 2,2'-azobis(2,4-dimethylvaleronitrile), a free radical initiator sold by DuPont under the trade designation "Vazo 52."

The aqueous phase consisted of 300 ml of a phosphate buffer having a pH of 4, 5 mg of a colloidal silica suspending agent sold by DuPont under the trade designation "Ludox TM," 1.5 ml of a 10 wt % solution of a condensation polymer of adipic acid and methyl amino ethanol, and 3 ml of a 12.5 wt % aqueous solution of potassium dichromate.

The organic phase was added to the aqueous phase under shear using a "Polytron" shear machine and was further sheared using a microfluidizer. The resulting suspension was polymerized at 50° C. after the addition of 5 ml of a 10 percent solution of a charge control agent. Shearing was continued for 17 hours and then at 70° C. for 4 additional hours. The reaction mixture was cooled and the toner beads were isolated by filtration and were washed with water. The beads were then washed overnight in 1N KOH containing 2 wt % of a surfactant sold by DuPont under the trade designation "Zonyl FSN" for 17 hours, and were isolated by filtration and washed with water to neutrality (pH=7). The beads were dried and had an average diameter of 8 micrometers. A photoconductive element that had been surface treated with zinc stearate was charged, exposed, and developed with a developer that consisted of 10 wt % of the toner beads and 90 wt % of a fluoropolymer coated hard ferrite carrier. The toned image was transferred to a plain paper receiver and virtually no residual toner image was left on the photoconductive film. The transfer efficiency of this toner was in excess of 99 percent.

EXAMPLE 2

Preparation of Piccotoner 1221 Toner Particles Containing 20% Hostaperm Pink E02 Pigment, 9% Lauric Acid and 5% Charge Agent In a 500 ml jar equipped with a magnetic stir bar was placed, ethyl acetate (200 g), melt pigment concentrate (20 g), 30 g Piccotoner 1221, and tetradecylpyridinium-tetra-phenylborate 0.25 g) dissolved in dichloromethane (5 mls). The melt concentrate contained Pliotone 4003(40 g) (available from Goodyear Rubber & Tire Company) and Hostaperm Pink E02(40 g) (available from BASF). Lauric acid (9 g) was added to the dispersion and stirred for 17 hours on a stir plate. The aqueous phase was made up of pH 4 buffer (750 mls), Ludox TM (12.5 mls), and 10% poly(adipic acid-co-methylaminoethanol) (3.75 mls). The organic phase was poured into the homogenized aqueous phase, stirring was continued for 3–4 minutes. The coarse dispersion was put through the Microfluidizer (40 psi) and into a 2 liter, 3 neck round bottom flask equipped with a paddle stirrer. The suspension was stirred at 100 RPM for 17 hours under a nitrogen sweep.

A water aspirator was attached and the dispersion stirred under vacuum for 3 hours. The vacuum was removed and the dispersion filtered through a coarse screen and collected on a fine fritted funnel, washed 3× with distilled water. The toner preparation was slurried in 1N KOH for 17 hours, collected on the same funnel and washed with distilled water until neutral pH.

The product was dried in a convection air oven at 40° C. for 17 hours.

EXAMPLE 3

Preparation of Branched Polyester Toner Particles Containing 6% Regal 300, 0.2% Charge Agent, and 1% Polymeric Dispersant In a 500 ml jar equipped with a magnetic stir bar was placed, ethyl acetate (200 g) and melt concentrate (50 g). The melt concentrate contained 0.4 IV branched polyester, (1410 g), Regal 300(90 g), charge agent(3 g). The polymeric dispersant (15 g) was added and the dispersion was stirred for 17 hours on a stir plate. The aqueous phase was made up of VWR buffer pH4 (833 mls), Nalcoag 1060(22.3 mls), and poly(adipic acid-co-methylaminoethanol) (6.6 mls, 10%). The organic phase was poured into the homogenized aqueous phase, stirring was continued for 3-4 minutes. The coarse dispersion was put through the Microfluidizer (40 psi) and into a 2 liter, 3 neck, round bottom flask equipped with a paddle stirrer. The suspension was stirred at 100 RPM for 17 hours under a nitrogen sweep.

An aspirator was attached and the dispersion stirred under vacuum for 3 hours. The vacuum was removed and the dispersion filtered through a coarse screen, collected on a filter funnel equipped with a medium porosity frit, washed with distilled water until filtrate was clear, slurried in 0.1N KOH for 17 hours, collected on a medium frit filter funnel, washed with distilled water until the pH was neutral, tray dried for 48 hours and sieved through 140 mesh screen.

Figure 2:
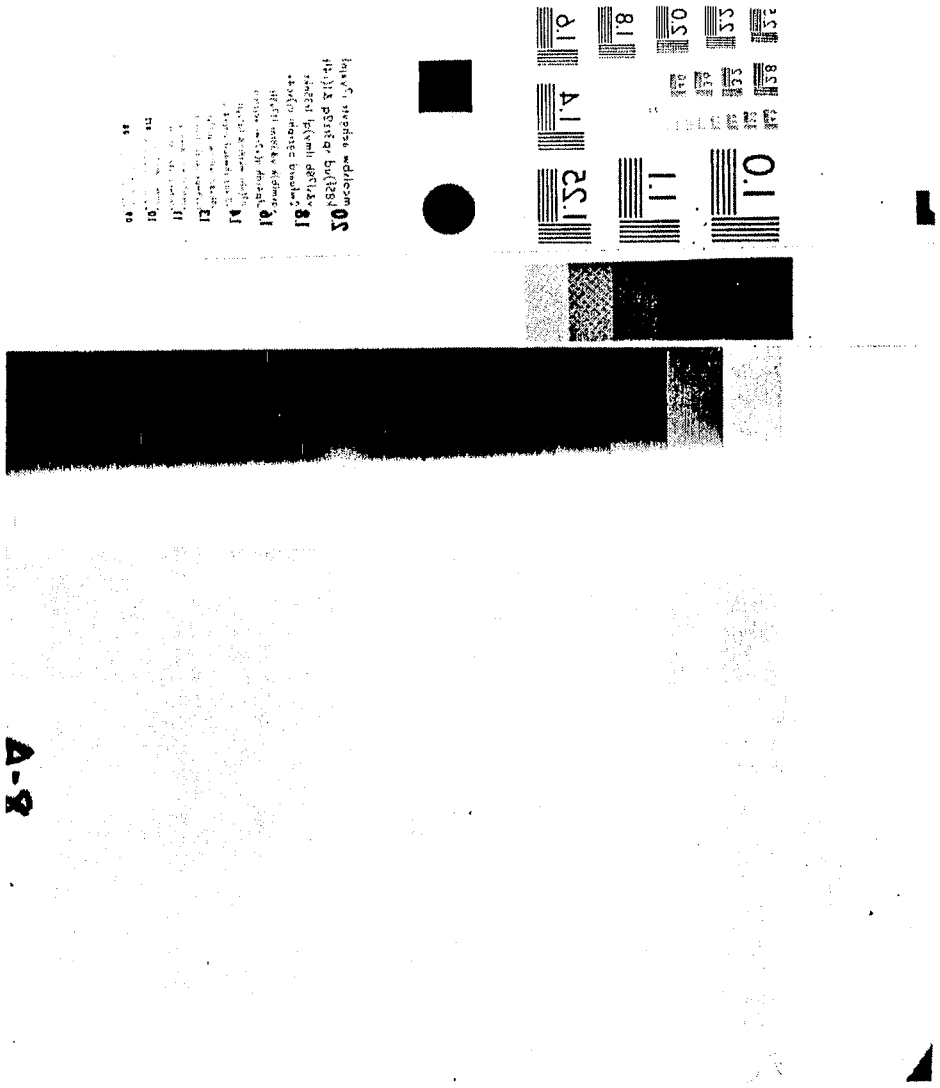
FIG. 2 is an electrophotograph of a transferred image and the transfer residue for a polymerization limited coalescence toner particle of the present invention.

The present invention is also illustrated by the drawings. FIG. 1 shows the transferred image on a receiver and the transfer residue on an element of a control toner particle having 8 weight % Regal TM 300 that is prepared by polymerization limited coalescence. FIG. 2 shows the transferred image and the transfer residue for toner particles of the present invention that contain oleoyl chloride and are prepared by polymerization limited coalescence.

Figure 3:
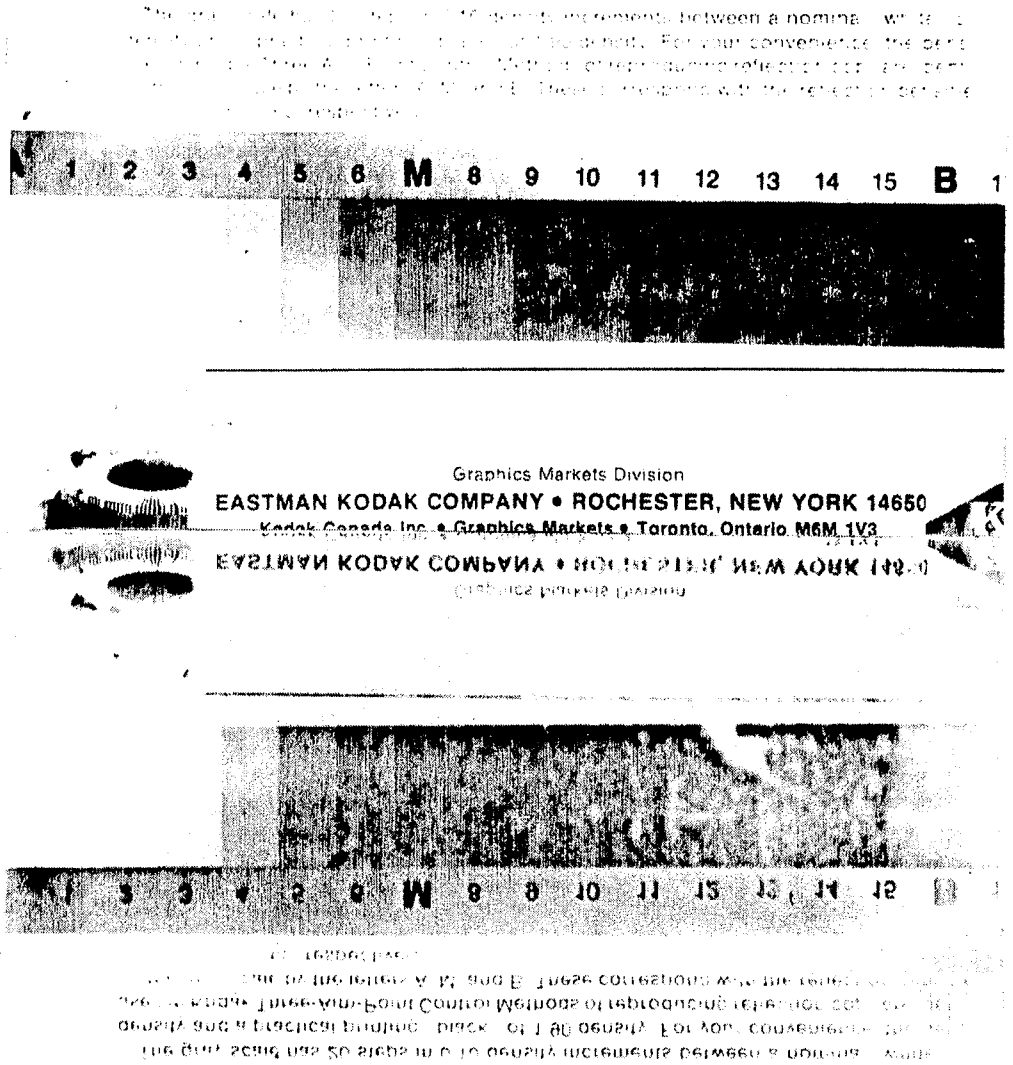
FIG. 3 is an electrophotograph of a transferred image and the transfer residue for an evaporation limited coalescence control toner particle.

Similarly, FIG. 3 represents the transferred image and the transfer residue of a control toner particle containing 6 weight % Regal TM 300 that is prepared by evaporation limited coalescence. This can be compared to FIG. 4 wherein the toner particles contain lauryl chloride.

Figure 4:
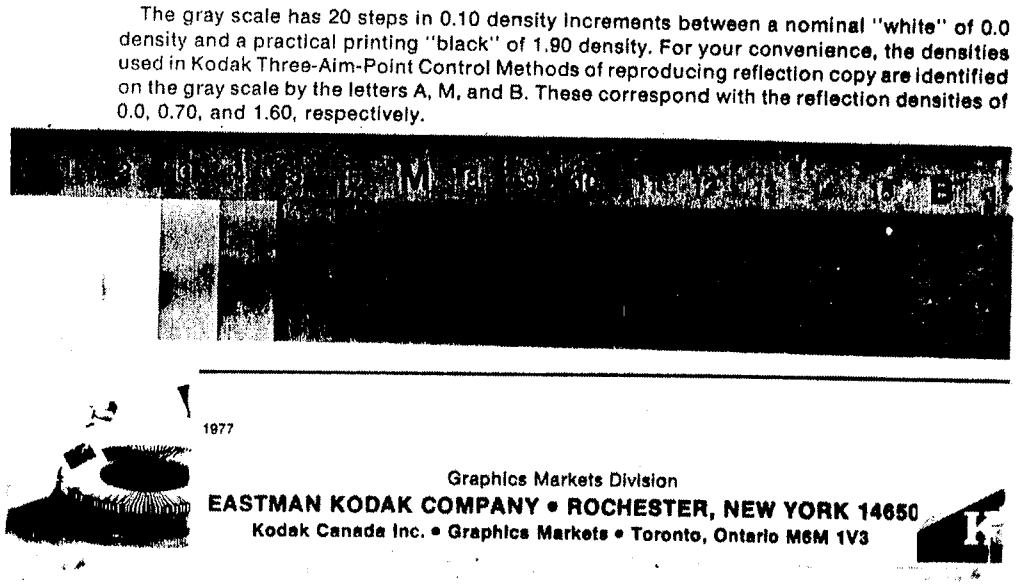
FIG. 4 is an electrophotograph of a transferred image and the transfer residue for an evaporation limited coalescence toner particle of the present invention.

FIG. 2 and FIG. 4 demonstrate the improved transfer efficiency of the toner particles of the present invention.

Figure 5:
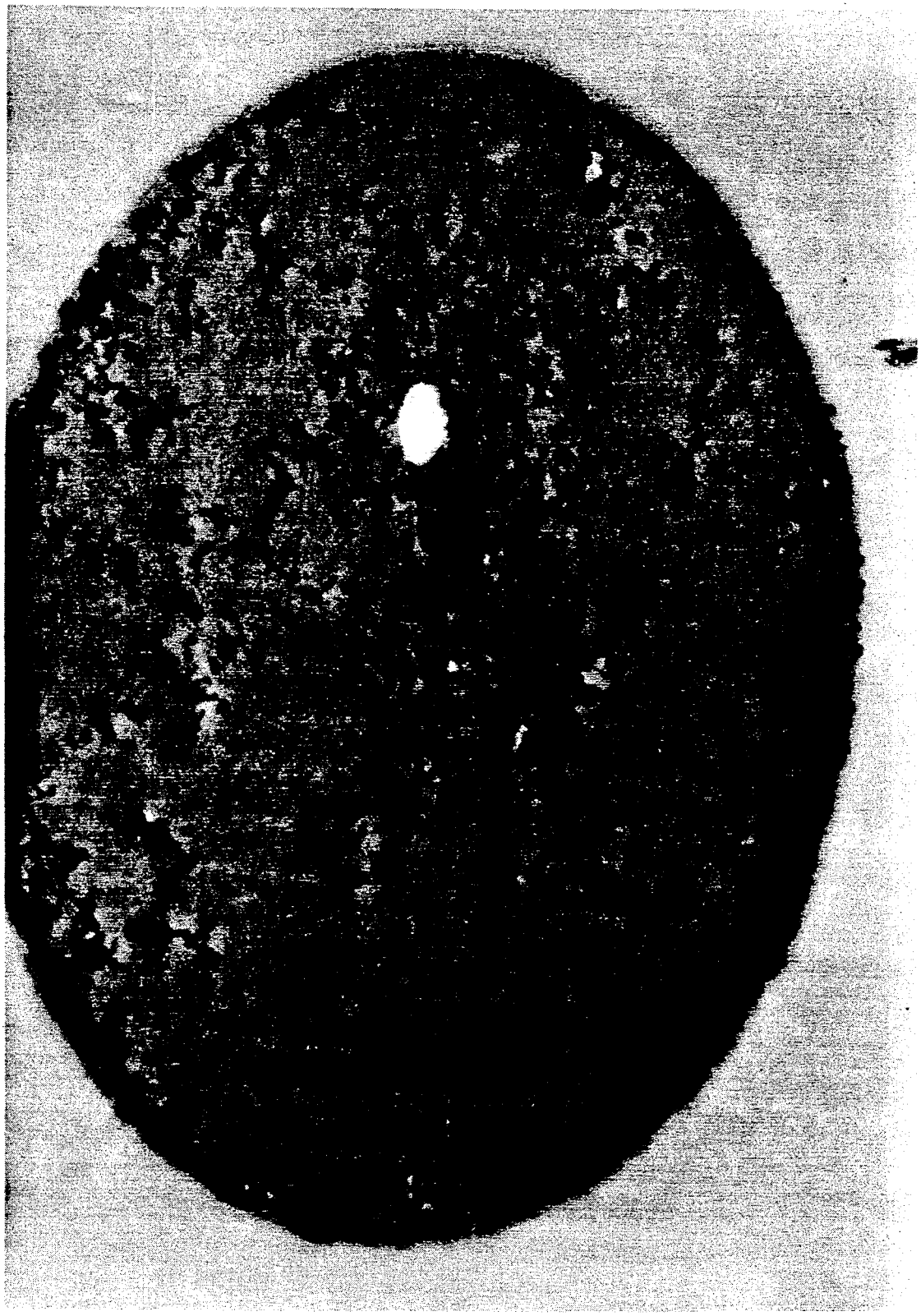
FIG. 5 is a cross-sectional view of a control toner particle magnified 39,000×.
Figure 6:
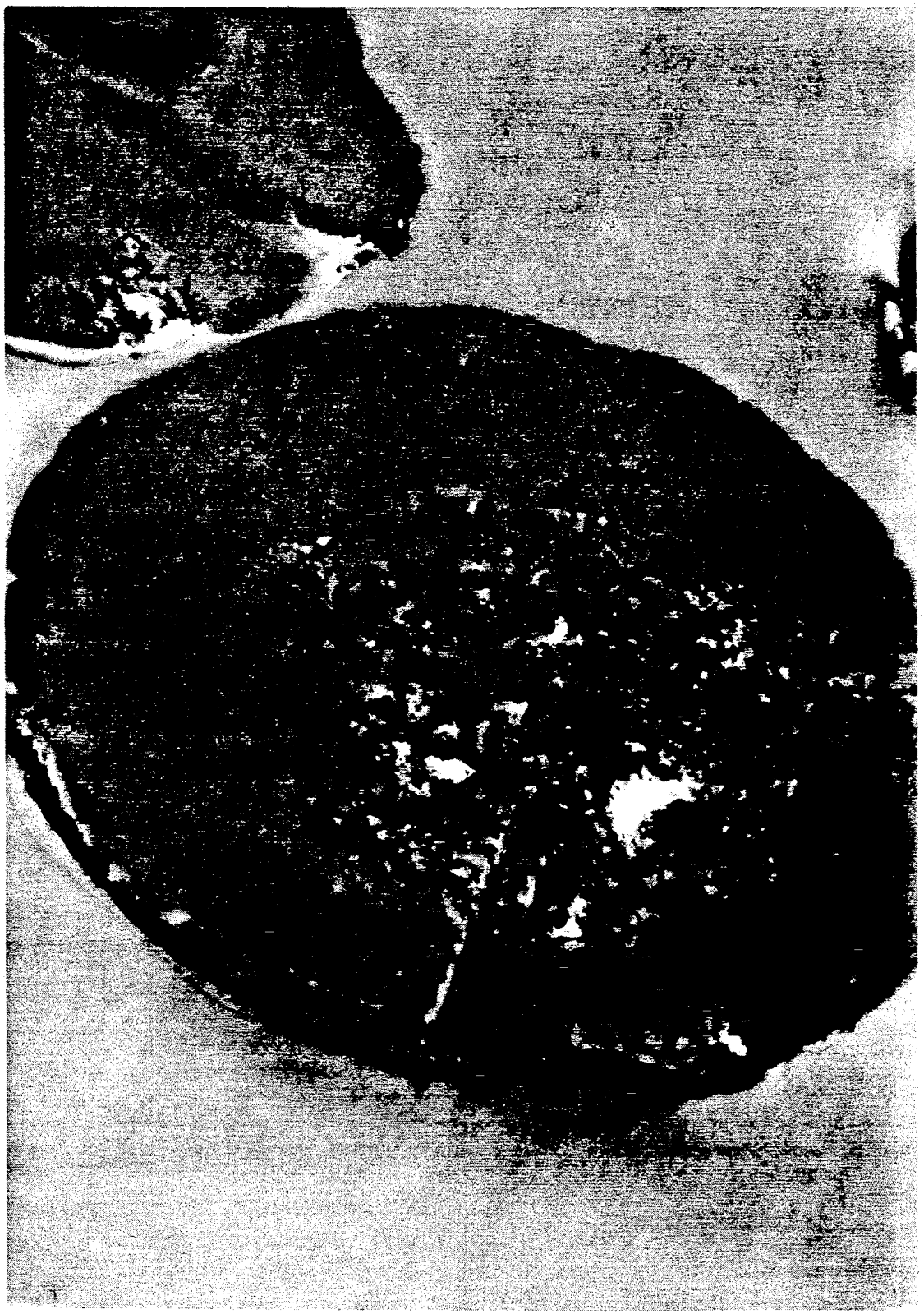
FIG. 6 is a cross-sectional view of a toner particle of the present invention magnified 30,000×.

FIG. 5 is a cross-section of a prior art toner particle of untreated Regal TM 300 carbon magnified 39,000× and, FIG. 6 is a cross-section of a toner particle of the present invention where the carbon has been treated with oleoyl chloride. FIG. 5 shows that there is a tendency for untreated carbon to migrate to the surface of the toner particle thereby interfering with transfer. FIG. 6 shows that most of the treated carbon has migrated to the center of the particle thereby improving transfer.

The foregoing specification is intended as illustrative and is not to be taken as limiting. Still other variations within the spirit and the scope of the invention are possible and will readily present themselves to those skilled in the art.

We claim:

1. A process for making pigmented toner particles wherein the pigment is dispersed in the individual toner particles, said process comprising the steps of:

(a) dispersing a hydrophilic, sub-micron sized pigment in a polymerizable liquid monomer mixture in the presence of a surface modifier which contains at least one functional group per molecule;

(b) admixing the dispersion under high shear conditions in an aqueous medium which has dispersed therein a particulate colloidally sized stabilizer, to produce micron-sized droplets of said dispersion in said aqueous medium;

(c) polymerizing said monomer mixture in said suspended droplets to produce solid particles comprised of a polymer matrix wherein said pigment is dispersed in interior regions of said particles; and (d) separating and drying said particles.

2. The process of claim 1 wherein said solid particles have a particle size in the range of about 1 to about 100 microns.

3. The process of claim 1 wherein a charge control agent is admixed with said dispersion.

4. The process of claim 1 wherein said surface modifier is soluble in said liquid monomer mixture.

5. The process of claim 1 wherein said pigment is carbon black.

6. The process of claim 1 wherein said surface modifier is a polycarboxylic acid which contains at least 5% by weight of carboxylic acid groups per molecule, and the remainder consisting of aliphatic hydrocarbon group containing at least about 8 carbon atoms.

7. A process for making pigmented toner particles wherein the pigment is dispersed in the individual toner particles, said process comprising the steps of:

(a) dispersing a thermoplastic polymer, a hydrophilic, sub-micron sized pigment, and a surface modifier which contains at least one functional group per molecule, in a water immiscible organic carrier liquid which has a boiling point below that of water;

(b) admixing under high shear conditions said dispersion with an aqueous medium which has dispersed therein a particulate stabilizer to produce a suspension of micron-sized droplets of said dispersion in said aqueous medium;

(c) stirring said suspension while evaporating therefrom said organic carrier liquid to produce solid particles comprised of a polymer matrix wherein said pigment is dispersed in interior regions of said particles; and (d) separating and drying said particles.

8. The process of claim 7 wherein said solid particles have a particle size in the range of about 1 to about 100 microns.

9. The process of claim 7 wherein a charge control agent is admixed with said dispersion.

10. The process of claim 7 wherein said pigment dispersion is soluble in said carrier liquid.

11. The process of claim 7 wherein said pigment is a carbon black.

* * * * *